US005564303A

United States Patent [19]

Buchanan et al.

[11] Patent Number: 5,564,303

[45] Date of Patent: Oct. 15, 1996

[54] INTERNAL MANDREL FOR USE IN PIPE BENDING

[76] Inventors: Robert W. Buchanan, 17502 E. Oklahoma St., Tulsa, Okla. 74116; Merle J. Malek, Rt. 2, Box 211, Chelsea, Okla. 74016

[21] Appl. No.: 475,371

[22] Filed: Jun. 7, 1995

[51] Int. Cl.[6] ..... B21B 25/00

[52] U.S. Cl. ..... 72/465; 72/466

[58] Field of Search ..... 72/370, 465, 466

[56] References Cited

U.S. PATENT DOCUMENTS

| | | | |
|---|---|---|---|
| 2,971,556 | 2/1961 | Armstrong et al. | 72/466 |
| 3,180,130 | 4/1965 | Avera | 72/465 |
| 3,279,237 | 10/1966 | Rader | 72/466 |
| 3,572,083 | 3/1971 | Schmitt | 72/466 |
| 3,580,044 | 5/1971 | DeVoss et al. | 72/466 |
| 4,006,619 | 2/1977 | Anderson | 72/58 |
| 4,123,930 | 11/1978 | Hill et al. | 72/466 |
| 4,315,423 | 2/1982 | McGuire | 72/466 |
| 4,378,689 | 4/1983 | Molz | 72/466 |
| 4,493,203 | 1/1985 | Wheeler et al. | 72/369 |
| 4,916,952 | 4/1990 | Thielmann et al. | 72/466 |
| 5,131,254 | 7/1992 | White | 72/466 |

*Primary Examiner*—Daniel C. Crane
*Assistant Examiner*—Ed Tolan
*Attorney, Agent, or Firm*—Catalano, Zingerman & Associates, P.C.

[57] ABSTRACT

An internal mandrel is disclosed which is used for supporting the inner wall of a pipe during bending. A plurality of unique resilient discs is provided. The discs are dome shaped with a rim at the bottom of the dome. The dome has a concave side and a convex side. The discs nest together, i.e. convex side of one into the concave side of the adjacent disc to form a resilient plug. A hydraulic cylinder applies force on the convex side of the outermost disc and the concave side of the innermost disc to deflect the rims of the disc outwardly to contact the inner wall of the pipe being bent.

14 Claims, 4 Drawing Sheets

INTERNAL MANDREL FOR USE IN PIPE BENDING

BACKGROUND OF THE INVENTION

1. Field of the Invention

This invention relates to the field of the bending of pipe and in particular to the support of the inner wall of the pipe during bending to aid and maintain a smooth interior surface of the pipe at the bending section.

2. Background Art

When laying pipe, it is nearly always required to bend the pipe so as to change its direction. It is a common practice to support the inner wall of the pipe at the point of the bend. If there is no internal support, the bending forces exerted on the pipe can cause deformation of the pipe. For example, if unsupported, that part of the inner wall of the pipe which becomes the inside bend may become wrinkled in that area.

Various devices and systems have been developed for use in providing this internal support of the pipe at the point of the bend. One such system is described in U.S. Pat. No. 4,493,203 issued Jan. 15, 1985 in the name of Wheeler et al and entitled: "Resilient Internal Mandrel." In that patent, the internal mandrel includes a urethane plug which is positioned between a piston of a hydraulic cylinder and an end plate. The resilient plug includes a plurality of individual flat discs made of urethane. An hydraulic cylinder is provided. The plurality of resilient flat discs with holes therethrough are supported on tie rods which are supported between the adapter plate cylinder and a first plate spaced therefrom. These flat discs are of uniform size in diameter and uniform thickness. Together with the placement of the tie rods, they become a resilient plug. A circular piston is driven by the hydraulic cylinder. The first circular end plate is used which has an exterior diameter only slightly less than the internal diameter of the pipe to be bent so that the first end plate can move freely through the pipe while maintaining a minimal gap between the outer periphery of the end plate and the interior wall. A second end plate is also provided, and it is rigidly secured to the cylindrical adapter plate. In operation, the resilient plug is inserted into the pipe and is positioned at the point to be bent. Hydraulic power fluid is then provided to the hydraulic cylinder. This pressure causes the piston to move toward the first end plate, thus compressing the resilient flat discs until they contact the internal wall of the pipe being bent. In this system the piston moves away from the cylinder toward the first end plate which is held in a fixed position with respect to the cylinder by the aforementioned tie rods. In this operation the resilient flat discs are compressed which reduces their thickness and at the same time expands them so that the outer edge of the disc contacts the internal wall of the pipe being bent. The pipe is then bent. After bending procedure is complete, the hydraulic piston is then de-pressurized, and the resiliency of the disc causes them to contract and then thus the mandrel can be moved.

The first end plate and the piston are of the maximum diameter which can be easily inserted through the pipe being bent so that extrusion of the resilient material between the edges of the end plate and piston and the wall of the pipe will be limited when the flat disc are compressed.

SUMMARY OF THE INVENTION

In accordance with the general aspect of the present invention, an internal resilient mandrel is provided for use with a pipe bender to bend pipe. In this preferred system, a hydraulic powered cylinder having a housing is provided. A cylinder plate is secured to the housing. A double D end plate is spaced from said cylinder plate. Parallel tie rods connect the cylinder plate to a double D end plate. A center plate having a center aligned with the center of the cylinder plate and the end plate is connected to the piston rod of the piston of the hydraulic cylinder.

There is a plurality of disc-like resilient members spaced between the center plate and the end plate. Each of these disc-like members have a hole therethrough through which the tie rods pass. Each disc-like member also has a dome having a base at the bottom and a rim integral with the dome and extending at least partially around the base. The dome of each disc-like resilient member has a concave side and a convex side. The inner side of the end plate contacts the side or a portion of the dome of the disc farthest from the center plate. The rim of the disc nearest the center plate contacts it. The plurality of the resilient disc members make up a resilient plug. The preferred material for these discs is urethane.

Power hydraulic fluid is supplied to the cylinder on the upstream side of the piston. Pressurized air supply is provided to the downstream side of the piston which is on the side toward the resilient mandrel.

When the tool is positioned at the point of the pipe where it is to be bent, hydraulic fluid is supplied to the hydraulic cylinder. Force is applied in the cylinder between the piston and the housing. The convex or top side of the dome is forced inwardly by the pressure of the force on the end plate. This dome takes less force to deflect than does the pushing on the base of the resilient disc by the center plate. Thus it has been our observation that the end plate and housing move together as a unit inasmuch as they are tied together by the tie rods. The end plate thus moves toward the center plate as the cylinder housing moves away from the piston. Thus the center plate is rather stationary within the pipe. This causes the dome of the disc to be flattened or deflected and the disc to take on more or less the shape of a plate rather than that of a soup bowl-like shape when it is in its natural or relaxed state. The individual plates are thus deflected until the outer sides of the rim come into firm contact with the inner wall of the pipe.

The resilient inner mandrel is now in position, and the bending operation may begin. After the bending operation is completed, the natural resiliency of the disc and an air spring on the hydraulic cylinder causes a disc to return from a deflected position to a relaxed position.

A better understanding of the invention can be had from the following description taken in conjunction with the drawings.

DETAILED DESCRIPTION OF THE PREFERRED EMBODIMENT

The internal mandrel described with respect to this drawing and specification is designed for use in bending pipe in a pipe bending machine which includes a bending die, stiffback, pin-up shoe, and associated power actuating means which are well known and have been described in the aforesaid U.S. Pat. No. 4,493,203. Therefore, they will not be shown in detail.

Figure 1:
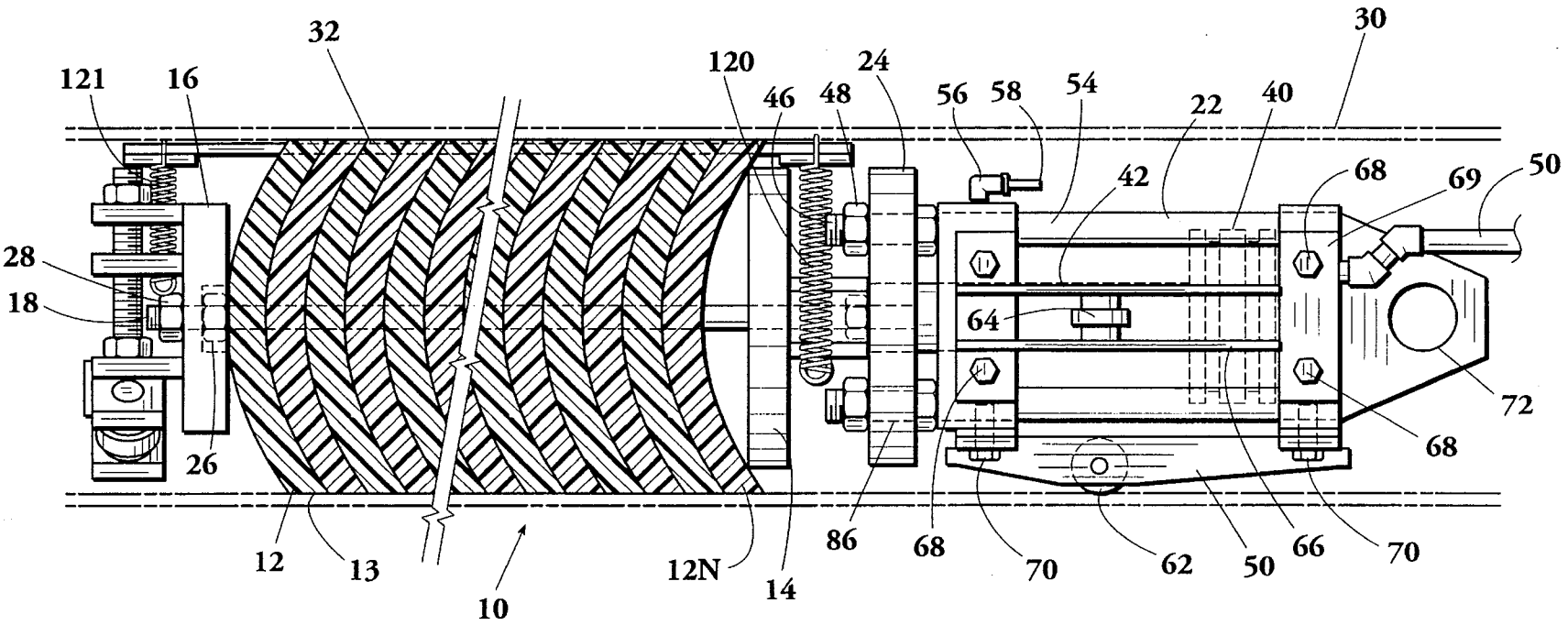
FIG. 1 is a view of the internal resilient mandrel of this invention with the resilient disc in cross-section along a vertical view and the rest of the Figure in full face view.

Attention is first directed to FIG. 1 which shows the resilient portion of the inner mandrel in a relaxed position. Shown thereon is the resilient section 10 comprising a plurality of essentially identical discs 12 to 12*n* positioned between center plate 14 and double D end plate 16. These discs are very unique and will be described in more detail in relation to FIGS. 5–7. Hydraulic cylinder 22 supports a cylinder plate 24 which is securely attached to the housing of the cylinder 22. Tie rods 18 are connected at one end to cylinder plate 24 which thus forms a support member for rods 18, and at the outer end are connected to end plate 16 by inner nut 26 and outer nut 28 which are mounted on the threaded end of the tie rods 18 and 20. The tie rods flex to the recommended degrees required for typical bending operation. Degrees per arc foot vary per pipe size. These discs 12—12*n* have holes 108 (FIG. 5) through which tie rods 18 and 20 extend. The end of the resilient section 10 closer to the hydraulic cylinder 22 is known as the inner end. That portion where the double D end plate 16 is located will be designated as the outer end. The double nuts 26 and 28 are used for adjusting the position of the end plate 16 against the disc 12. The nut 26 is set in a recess within the end plate 16.

Figure 5:
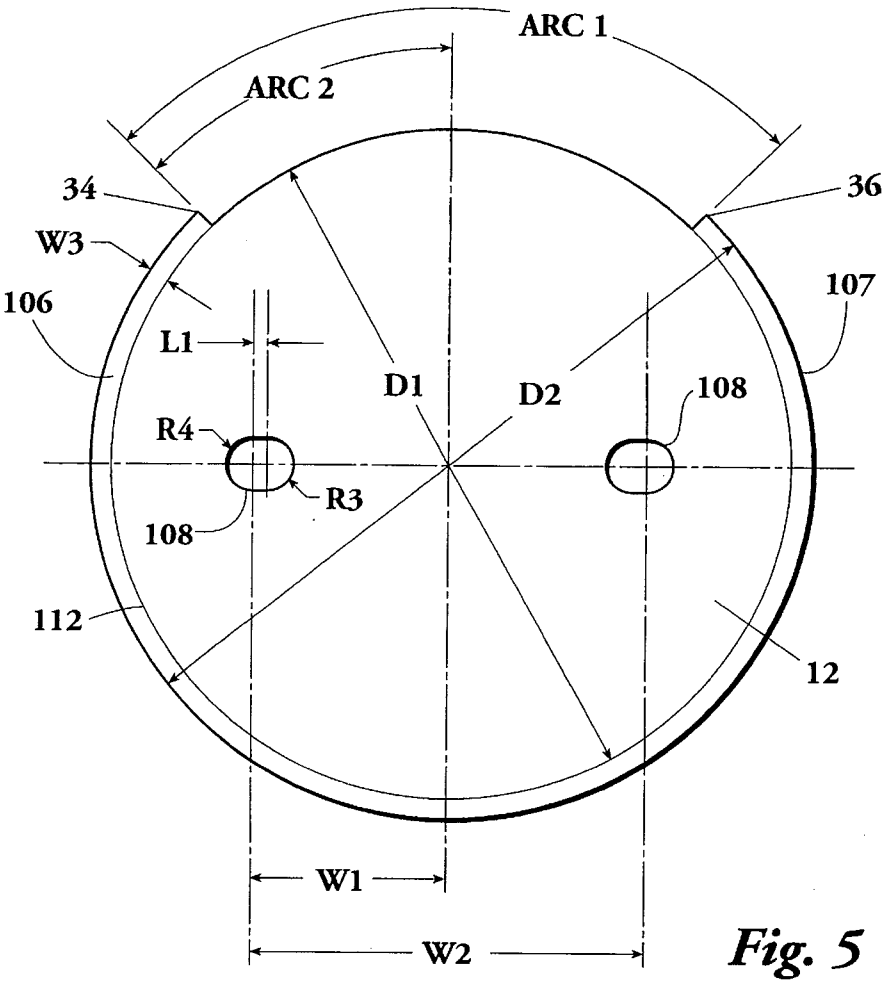
FIG. 5 is a top view of the disc.

A number of resilient flexible strips 32 are positioned at the top of the resilient discs and rests in the space as shown in FIG. 5 between points 34 and 36, which are the end points of lip or rim 107 of the resilient disc 12. It is known to use such strips, and they can be formed of spring steel secured either to the end plates of disc 12 by any acceptable and known means. In the drawing they are shown as being secured by means of retaining springs 120 and 121 at each end. Spring 120 is connected around a stud on center plate 14 for receiving piston rod 42 and the end of flexible strips 32. Spring 121 can be connected between the other end of strip 32 and a bracket associated with end plate 16.

Attention will now be directed briefly to the cylinder 22 which is provided with a piston 40, with a piston rod 42 which connects to the center plate 14. The cylinder plate 24 is connected to the housing body of cylinder 22 by bolts 46 and nuts 48. Thus plate 24 is thus rigidly secured to the body or housing of hydraulic cylinder 22. A power fluid conduit 50 is provided to the power side 52 of piston 40. The downstream space 54 of the hydraulic cylinder which is the opposite side from the power side of the piston 40 is provided with an air conduit 56 which has a shut off valve 58 which may be quite similar to the valve in pneumatic tires.

As the tool must be inserted into the pipe 30, the hydraulic cylinder is normally provided with rollers. In this case, there is a wheel bracket assembly 60 with bottom wheels 62; a side wheel 64 supported from a wheel bracket assembly 66 which is supported from the housing by a plurality of bolts and nuts 68. The bottom wheel bracket assembly 60 is supported by bolts 70 from the housing. A connector 72 for the reach rod is provided on the right-hand end of the cylinder 22. These connectors and reach rods are well known.

Figure 2:
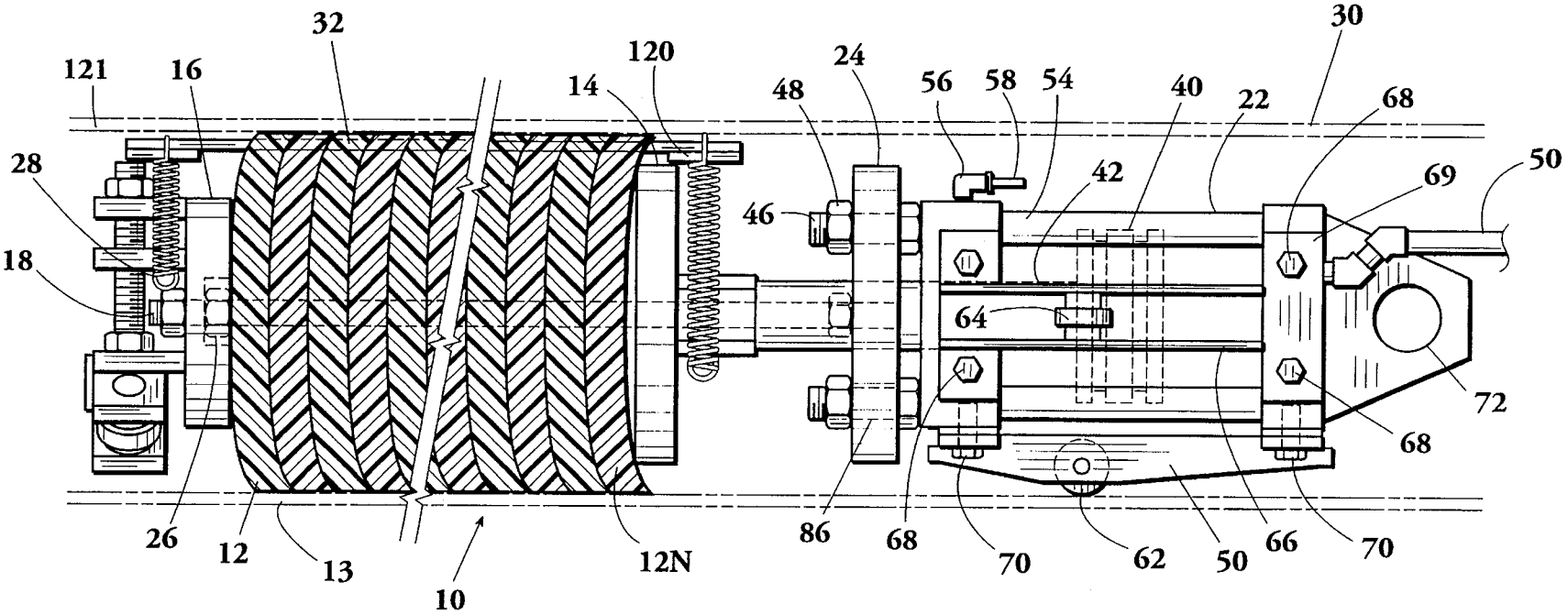
FIG. 2 is similar to FIG. 1 except that the resilient discs have been deflected by applying pressure between a center plate and an end plate so that the edges of the plates contact the inner wall of the pipe to be bent.
Figure 4:
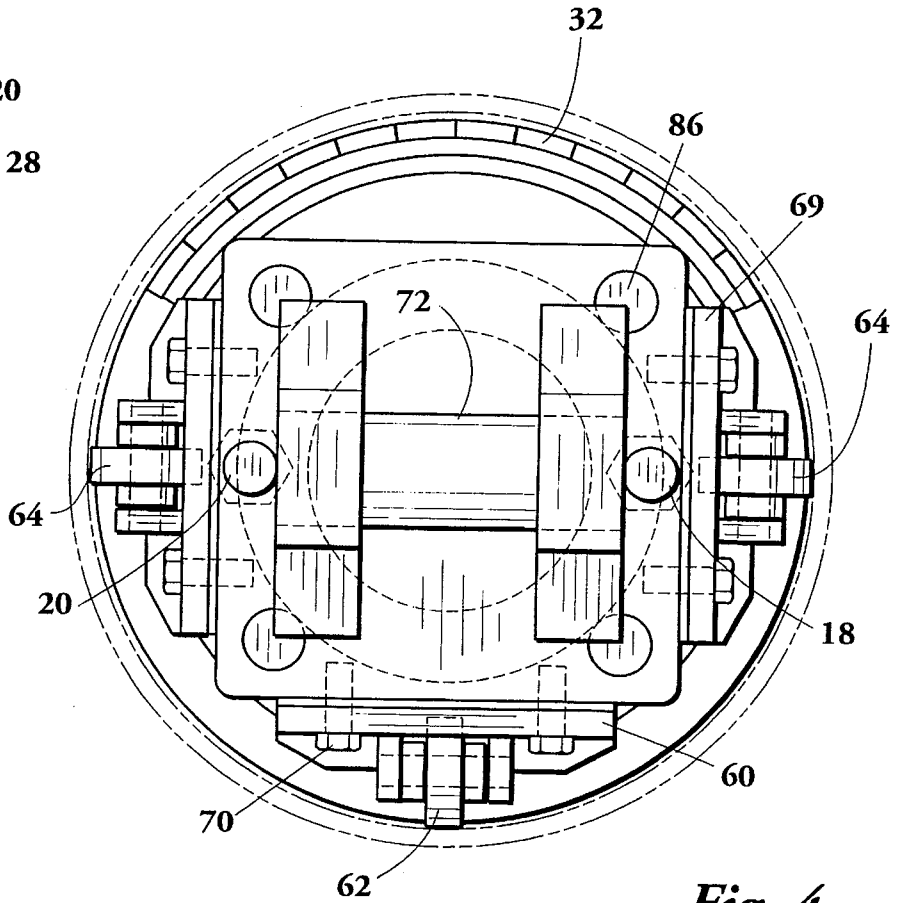
FIG. 4 is an end view of FIG. 1 looking in the direction toward the hydraulic cylinder or right side of the drawing.
Figure 3:
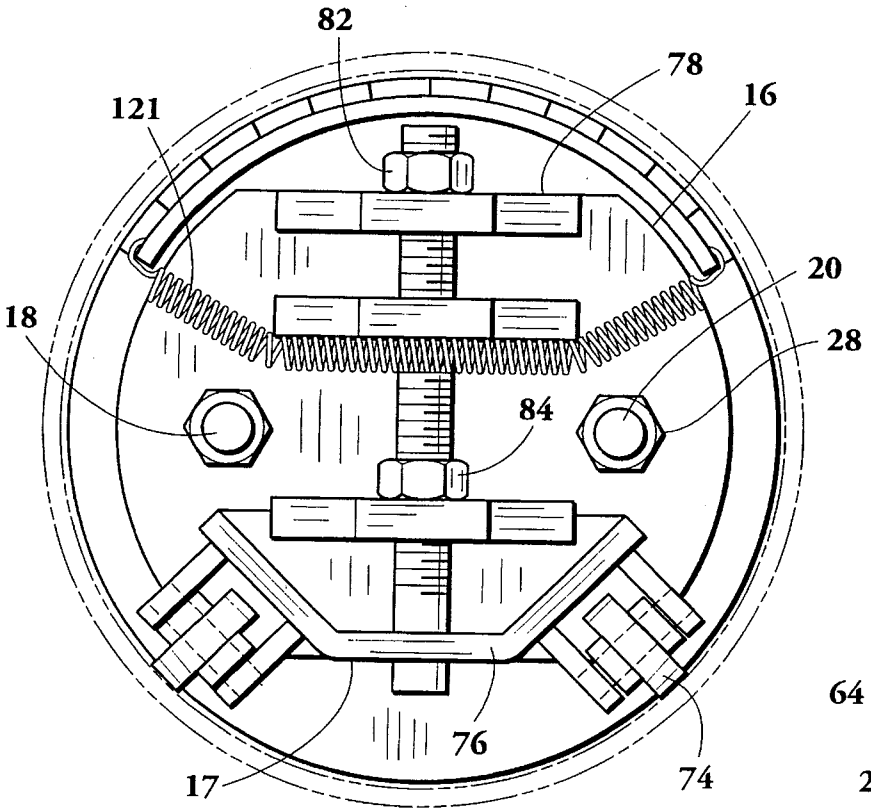
FIG. 3 is an end view of the left side of FIG. 1.

FIG. 3 shows the outer end view of the device of FIGS. 1 and 2 and includes front wheels 74 supported from first bracket 76 and second bracket 78 which are supported from the double D end plate 16 and extends through brackets 76 and 78 through non-threaded holes. They are held in position by nut 82 which is on one side of bracket 78 and a nut 84 which is associated with the top side of bracket 78. A spring 84 is between nut 84 and one side of the bracket 78. Shown in FIG. 4 are four cylinder tie rods 86 with nuts 46 which hold the cylinder together.

Figure 6:
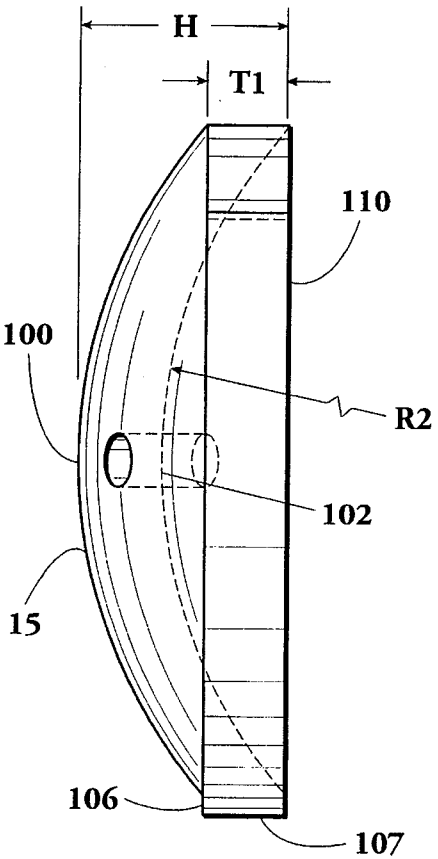
FIG. 6 is a side view of FIG. 5.
Figure 7:
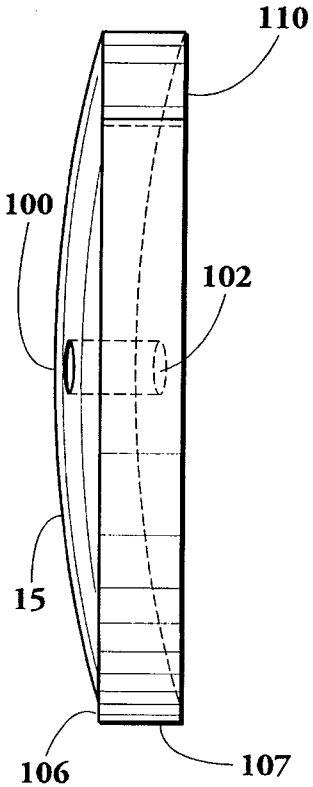
FIG. 7 is similar to FIG. 6 but illustrates the contour of the disc when in the deflected position.

Before discussing the operation of the device shown in FIGS. 1 and 2, it will be helpful to have a detailed discussion of the disc 12 which is a key element. Attention is therefore directed towards FIGS. 5, 6, and 7. FIGS. 5 and 6 which are shown in the relaxed position, and FIG. 7 illustrates the deflected position. As can be seen in FIG. 5, this is generally shaped as a spherical segment having a dome. There is a dome-like or hemispherical portion 15 having a top or convex side 100 and a concave side 102. The dome thickness at its apex is 1 ⅛ inches in this particular manufactured disc. There is a rim 107 which is largely a cylindrical shape. In the preferred embodiment there is an annular shoulder 106 of rim 107. A preferred material of disc 12 is urethane, although other elastomeric materials can be used.

Rim 107 is essentially cylindrical and has a height or thickness $T_1$ (see FIG. 6), the dome top has a radius $R_1$, the dome concave side has a radius $R_2$. As shown in FIG. 6, there is a distance H between the top of the dome top 100 and the bottom 110. As shown in FIG. 5, the annular shoulder 106 has a width $W_3$, the space between ends 34 and 36 of shoulder 106 is an $arc_1$ and half of that is designated $arc_2$. The holes 108 are oblong and preferably on a diameter running through the center of the circle 112. A top to bottom dimension of these holes 108 are only slightly larger than the diameter of the tie rods, but the major axis of those holes is sufficiently large to permit the disc 12 to deflect when force is applied without binding on the tie rods.

A resilient disc 12 has been built and has the following typical dimensions shown in list below, for a 10.75" outside diameter pipe. These dimensions given are suitable for pipes having thicknesses of ⅛" and ¼". For convenience of ready review, many of these dimensions are shown on FIGS. 5 and 6.

| | |
|---|---|
| $R_1$ | 7.603" |
| $R_2$ | 7.603" |
| H | 2.800" |
| $T_1$ | 1.150" |
| $W_1$ | 2.812" |
| $W_2$ | 5.625" |
| $W_3$ | .25" |
| $D_1$ | 9.705" |
| $D_2$ | 10.063" |
| $arc_1$ | 90.00° |
| $arc_2$ | 45.00° |

The holes 108 are typically oblong and have two centers which are $L_1$ apart which is 0.125". One end of the hole has a radius $R_3$, and another side is $R_4$ and typically has a radius of 0.391. The centers of arc 100, arc 102, and apex of the dome all lie on essentially a straight line in this particular manufactured dome. It is to be emphasized that the dimensions given in regard to the disc 12 are not to be in any way limiting but are merely typical to show the size of one disc that has been built and tested successfully. Generally speaking the shape of the disc is a spherical segment (or bowl-like shape) when in the relaxed position. When deflected, it takes on more of a plate-like appearance as shown in FIGS. 2 and 7.

Having described the general components of the inner mandrel, attention will now be directly briefly towards its operation. When it is desired to use the device in a pipe which is to be bent at a particular location, a conventional reach rod is connected to connector 72 or the hydraulic cylinder housing. Then the mandrel as shown in FIGS. 1 and 2 is inserted into the pipe and supported by the various wheels or rollers shown until the location of the pipe to be bent is reached. This can be positioned in a known manner. Disc 12 are in the position shown in FIGS. 1 and 2. Before insertion, air pressure is supplied through air conduit 56 until the space 54 is under a predetermined pressure which typically can be about 90 psi. Then, power fluid is provided through conduit 50 to the power side 52 of the piston 40. The end plate 16 is in contact with the outer top of the dome of disc 12. The center plate 14 is in contact with the surface toward the edge or rim of disc 12n as shown in FIG. 1. End plate 16 can be considerably smaller than the inside diameter of the pipe 30. For example, for a 10" pipe, the clearance between the side 17 and the maximum distance between it and an interior wall of the pipe may be large. This is possible because there is no concern for the material of the disc 12 extruding around it. In this arrangement there is essentially no extrusion of the disc. It is noted that the end plate 16 is on the crown of the dome of disc 12. When force is applied to the hydraulic cylinder, there will be essentially no movement of the center plate 14; that is, it will be essentially stationary in the pipe to be bent. However, the end plate 16 will be pulled to the right by rods 20 which are connected to the housing of the hydraulic cylinder 22. The hydraulic cylinder 22 will move to the right as piston 40 stays in essentially the same position because it is connected to the center plate 14. As pressure is applied to the power side of the piston 52, it will therefore move the housing of the cylinder instead of the piston. The force then is applied to the disc 12 to 12*n* between end plate 16 and the outer portion of center plate 14 which is in contact with disc 12n. The continued force of the double D end plate against the crown of disc 12 will cause the discs to become deflected as shown in FIG. 2. It was observed that the thickness of the dome section apparently was not compressed. What causes the disc to expand against the wall of the pipe is considered to be the increased distance between the edges 13 and 15 caused by deflection as can be seen between FIG. 1 and FIG. 2. In FIG. 1 the disc 12 takes on the general shape such as a soup bowl or dome, whereas in FIG. 2 they have been flattened or deflected into more or less into a plate shape.

Forceful compression of the thickness of the dome has not been detected when operated. From observation, it is believed that the deflection of the dome is what causes the outer rim or edge of the lower end or rim of the disc 12 to extend outwardly or extend to a greater diameter, thus causing the rim to contact the interior of the pipe at the point where it is to be bent.

In one operation the down side of piston 40 was pressurized with 90 psi air. During the compression operation the pressure increased to approximately double that put in. Thus it becomes what may be called an air spring.

After the bend in the pipe has been made, the hydraulic pressure in line 50 is relieved and permits the disc 12 to return to the relaxed position shown in FIG. 1 from that shown in FIG. 2. There are two forces which expedite this. One is the air spring which when the hydraulic fluid pressure is relieved, forces the piston 40 and the housing of the cylinder apart. The other force is the resiliency force of the discs themselves which have a tendency to return to their normal shape as shown in FIG. 6. The relaxed resilient inner mandrel of FIG. 1 can then be moved to the next position in the pipe as may be detected by the spot to be bent.

Various modifications can be made of this invention. For example, any means of force can be applied to center plate 14 and end plate 16. These could include any mechanical or electric device, such as jack screws, boom mechanisms, or even manual force for the small diameter pipe.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An internal resilient mandrel for use with a pipe bender to bend a pipe, comprising an end plate;

a center plate;

a support member;

at least one rod extending through said center plate and between said support member and said end plate;

at least one resilient disc supported by said rod between said end plate and said center plate, each said disc having a symmetrical dome having a base, a rim at the base of said dome and integral therewith, such rim extending at least partially around said base, and deflectable against the pipe upon movement of said end plate and said center plate in relation to each other.

2. A mandrel as defined in claim 1 including power means to drive said end plate towards said center plate.

3. A mandrel as defined in claim 2 in which said power means includes an hydraulic cylinder having a piston, a piston rod attached to said center plate, and in which said support member is a cylinder plate secured to said hydraulic cylinder, a hole in said disc for each rod, each said tie rod slidably extending through a hole in said disc.

4. An internal resilient mandrel as defined in claim 1 in which said disc is a unitary member and its dome has a concave side and a convex side and a lower circular base, said dome shaped as a hemispherical segment with the radius of said convex side and of said concave side being approximately the same length, the center of the apex of said dome, the center of radius of the concave side and the center of the convex side all being on the same straight line.

5. A resilient inner mandrel for use with a pipe bender to bend a pipe comprising a fluid actuated cylinder having a housing, a piston with a piston rod connected thereto, a source of power fluid on the power side of said piston;

means to inject pressurized gas into the downstream side of said piston;

a center plate attached to said piston rod;

an end plate spaced from said center plate away from said cylinder;

at least two parallel tie rods supported at one end from said end plate and at the other end supported from said body of said housing;

a plurality of resilient disc-like members having holes therethrough through which the tie rods extend;

each said disc-like member includes a dome with a base and having a concave side and a convex side, and a lower periphery at its base and a rim integral with said dome at said periphery and extending at least around a large part of said periphery.

6. A mandrel as defined in claim 5 in which the radius of the convex side and the concave side of the dome are the same length.

7. An inner mandrel as defined in claim 5 in which said rim provides an annular shoulder exterior said dome which extends around not over 270° to form an annular gap in the rim; and flexible strips positioned along the length of the mandrel in said gap.

8. A unitary disc-like member for use in pipe bending comprising;

a dome having a concave side and a convex side and a base;

a rim integral with said dome at said base and extending at least around a large part of said base and made of a resilient material, the exterior of said rim having a cylindrical shape;

said dome having at least one hole extending therethrough.

9. A disc-like member as defined in claim 8 in which the radius of the convex side and the concave side are the same length.

10. A disc-like member as defined in claim 9 in which said resilient material is urethane.

11. A disc-like member as defined in claim 8 in which there are two spaced apart parallel holes therein and in which such holes are oblong.

12. A unitary disc-like member according to claim 8 in which said dome has at least two holes therethrough.

13. An internal resilient mandrel for use with a pipe bender to bend a pipe, comprising:

an end plate;

a center plate;

a support member;

at least two tie rods extending through said center plate and between said support member and said end plate; at least one resilient disc supported by said rods between said end plate and said center plate, each said disc having a symmetrical dome having a base, a rim at the base of said dome and integral therewith, such rim extending at least partially around said base;

power means to drive said end plate toward said center plate.

14. An internal resilient mandrel as defined in claim 13 in which said power means includes:

an hydraulic cylinder having a piston, a piston rod attached to said center plate, and in which said support member is a cylindrical plate secured to said hydraulic cylinder, a hole in said disc for each said rod, each said tie rod slidably extending through a hole in said disc.

* * * * *